United States Patent [19]

Borodin et al.

[11] 4,081,001

[45] Mar. 28, 1978

[54] APPARATUS FOR PROPELLING THE WEFT THREAD CARRIERS IN TRAVELLING-WAVE LOOMS

[76] Inventors: Valerian Alexeevich Borodin, ulitsa Gubkina, 4, kv. 74; Eduard Arshakovich Onikov, ulitsa Panferova, 5, korpus 2, kv. 106; Boris Alexandrovich Sakharov, ulitsa Krzhizhanovskogo, 24/35, korpus 6, kv. 404; Alexandr Alexandrovich Zabotin, Belyaevo-Bogorodskoe, kvartal 45, korpus 26, kv. 85, all of Moscow; Evgeny Dmitrievich Loschilin, ulitsa 8 Marta, 34a, Moskovskaya oblast, Domodedovo; Alexandr Lvovich Galperin, ulitsa Moldagulovoi, 10, korpus 3, kv. 166, Moscow, all of U.S.S.R.

[21] Appl. No.: 725,350

[22] Filed: Sep. 21, 1976

[30] Foreign Application Priority Data

Sep. 23, 1975 U.S.S.R. ..... 2170552

[51] Int. Cl.[2] ..... D03D 47/26

[52] U.S. Cl. ..... 139/436

[58] Field of Search ..... 139/13, 190, 436, 429

[56] References Cited

U.S. PATENT DOCUMENTS

| | | | |
|---|---|---|---|
| 3,729,029 | 4/1973 | Zabrodsky et al. | 139/436 |
| 3,908,706 | 9/1975 | Onikov et al. | 139/436 |
| 3,923,083 | 12/1975 | Balantsev et al. | 139/436 |
| 3,934,619 | 1/1976 | Loschilin et al. | 139/436 |

*Primary Examiner*—Henry S. Jaudon

[57] ABSTRACT

The apparatus includes a closed stationary guideway incorporating a chain conveyer having means for propelling the weft-thread carriers. The closed stationary guideway has two curvilinear and two rectilinear portions. Above one of the curvilinear portions and above the rectilinear portions of the guideway, except for the part thereof disposed in a cloth forming zone, there is installed an additional guideway slidably engaging a guide surface made on the top side of the weft thread carriers. Located above the other curvilinear portion of the closed stationary guideway are movable retainers contacting surfaces of the weft thread carriers. Thus, the above structure reliably retains the weft thread carriers against vertical displacements and to use for propelling the weft thread carriers out of the shed the very same elements used for propelling them in the shed.

6 Claims, 8 Drawing Figures

APPARATUS FOR PROPELLING THE WEFT THREAD CARRIERS IN TRAVELLING-WAVE LOOMS

BACKGROUND OF THE INVENTION

At present, there are known apparatus for propelling the weft thread carriers in a travelling-wave loom.

In these known apparatus there are provided closed stationary guideways having rectilinear and curvilinear portions and endless chain conveyers accommodated in these guideways and carrying two types of elements. Some of the elements are adapted to cooperate with the weft thread carriers moving in the shed, whereas other elements find lodgement in holes of the very same carriers when the latter move outside the shed along the stationary guideway. On the outside of the stationary guideway, to match the rectilinear and curvilinear portions thereof, is a side wall serving as a guideway for a lateral side of the weft thread carrier. At its curvilinear portions this wall is L-shaped in cross-section, and one end thereof is secured on the guideway, while the other free end is directed towards the weft thread carriers. On the carrier lateral side interacting with this side wall there is an arcuate recess receiving the free edge of the side wall during movement of the carrier along the curvilinear portions of the guideway.

As has been mentioned above, for the carriers to travel outside and inside the shed, use is made of two types of elements. This makes the structure of the chain conveyor complicated and the movement of the carriers difficult. Thus, the elements propelling the weft thread carriers outside the shed enter respective holes in the carriers and, due to multiple displacements, introduce fluff thereinto. As a result, the holes are clogged with fluff and the elements are seized in the holes. Besides, after the carriers emerge from the shed at the place where the elements enter the holes, the former move in the guideways at a gap occupied by the warp threads during movement in the shed. This causes misalignment of the elements and the carriers and leads to improper operation of the mechanism and to bumps.

SUMMARY OF THE INVENTION

The object of the present invention is to obviate the disadvantages.

The principal object of the present invention is to provide an apparatus for propelling the weft thread carriers in travelling-wave looms which will accomplish reliable propelling of the weft thread carriers with the use of the same elements for propelling these carriers both inside and outside the shed.

This object is attained, in an apparatus for propelling the weft thread carriers in travelling-wave looms, by providing a closed stationary guideway extending through the cloth forming zone, accommodating a chain conveyer which bears means for propelling the weft thread carriers, and provided with side walls in contact with the lateral side of the carriers and being L-shaped at the curvilinear portions. In accordance with the invention, above one of the curvilinear portions of the closed guideway as well as above the rectilinear portions thereof, except for the part located in the cloth forming zone, there is installed an additional guideway disposed in the plane of flight of the carriers and contacting the top side of the carriers, while above the other curvilinear portion of the closed guideway, from the inside, there are arranged, movable in plane of the flight of the carriers and in step with the motion of chain conveyer, retainers in contact with the lateral sides of the carriers which are provided on the top sides with rectilinear surfaces adapted to accommodate an additional guideway.

The additional guideway makes it possible to reliably guard the weft thread carriers flying outside the shed against eventual vertical displacements and to use, for propelling the carriers outside the shed, the very same elements which propell them in the shed. This considerably simplifies the structure of both the chain conveyer and the weft thread carriers.

Arrangement of the additional guideway in a rectilinear guide surface on the top sides of the carriers enables restricting the movement of the carriers along the path of movement and thereby to improve the reliability of operation of the apparatus for propelling the carriers and of the loom in its entirety.

Provision of movable retainers at one of the curvilinear portions allows to dispose therein the devices for winding the weft thread onto the spools of the moving carriers and to dispense with the additional guideways at this portion, which, in turn, makes it possible to hold the weft thread carriers in a definite position in the course of winding.

The sides of the carriers are preferably provided with recesses for movable retainers due to which the reliability of movement of the carriers is improved, and the motion of the carrier due to inertia at loom stopping is prevented. This, in turn, enables breaking of the winding device to be avoided. It is expedient to make these recesses in the weft thread carriers in the front or leading part thereof.

According to an alternative embodiment of the invention, the movable retainers are arranged vertically along the carriers in two rows one above the other, the spacing between the retainers in each row being equivalent to the spacing between the weft thread carriers.

It is preferable to locate near the retainers, movable in the plane of flight of the weft thread carriers and in step with the motion of the chain conveyor, abutments in contact with the rear surface of the weft thread carriers. In this way, the speed of travel of the weft thread carriers and, in the final analysis, the productivity of the loom are increased.

According to another feature of the invention, the retainers and the abutments extend radially and are secured on a turnable disk disposed at the inside of the closed guideway and geared to the drive of the chain conveyer.

Thus, the herein disclosed apparatus for propelling the weft thread carriers in a travelling-wave loom simplifies to a great extent the means for propelling the carriers, secures reliability of motion of the weft thread carriers and enables high speeds of flight thereof.

BRIEF DESCRIPTION OF DRAWINGS

Given below is a detailed description of the present invention with reference to the accompanying drawings, wherein.

DESCRIPTION OF PREFERRED EMBODIMENTS

Figure 1:
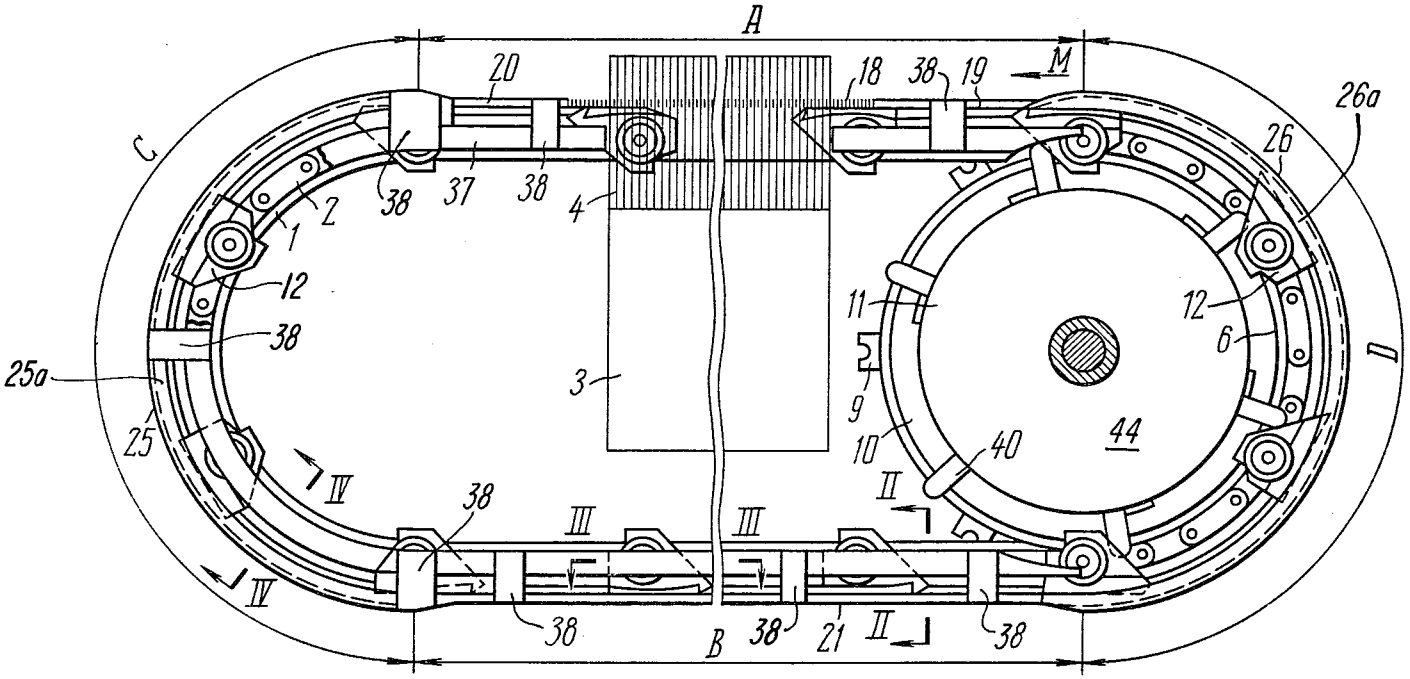
FIG. 1 is a schematic representation of an apparatus for propelling the weft thread carriers in a travelling-wave loom, top view.

Referring now to the drawings, the apparatus for propelling the weft thread carriers in a travelling-wave loom comprises a closed stationary guideway 1 (FIG. 1) with a chain conveyer 2 moving therein. The guideway 1 is made up of rectilinear portions A and B and curvilinear portions C and D which respectively have equal radii.

The stationary guideway 1 is arranged so that the curvilinear portions C and D thereof are disposed at the ends of the loom. The rectilinear portion B overlies a formed cloth 3, whereas the rectilinear portion A is disposed within the cloth forming zone, i.e. beneath warp threads 4 forming the shed.

The guideway 1 (FIG. 2) is U-shaped in cross-section and vertical walls 5 and 6 thereof are of different heights, the wall 6 forming the inner side of the guideway and being higher than the wall 5 forming the outer side thereof. Thus, the lower outer wall 5 forms a space for the lower threads 4 of the shed at the cloth-forming zone where the rectilinear portion A is situated.

Figure 3:
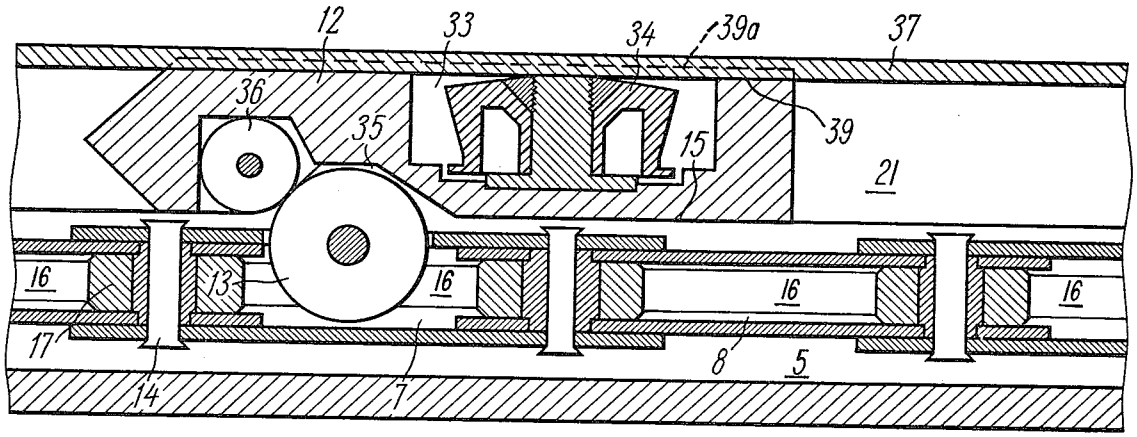
FIG. 3 is a section along line III—III in FIG. 1.

In this guideway 1, between the walls 5 and 6 thereof, there is placed the chain conveyor 2 which is actually a well known link-and-roller chain composed of interconnected links 7 and 8 (FIG. 3).

The chain conveyer 2 is driven into motion by teeth 9 (FIG. 1) of a disk 10 of a device 11 for winding the weft thread onto the spools of weft thread carriers 12 located at the curvilinear portion D of the guideway 1 and adapted to propell the weft thread carriers 12 along the guideway 1 both in and out of the shed. In both cases, the propelling is effected with the aid of rollers 13 (FIG. 3) mounted on the links 7.

The links 7 and 8 of the conveyer 2 are made of equal length and interconnected by pins 14, the links 8 being arranged in the chain according to the spacing between the carriers 12.

Figure 2:
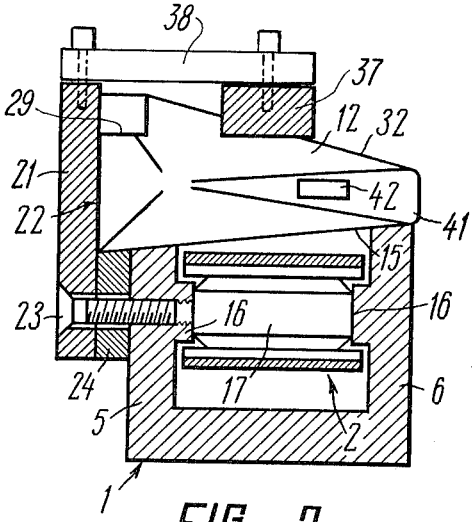
FIG. 2 is a section along line II—II in FIG. 1.
Figure 4:
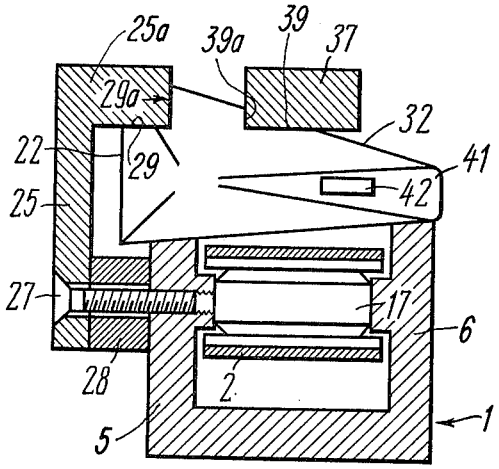
FIG. 4 is a section along line IV—IV in FIG. 1.

The chain conveyer 2 (FIG. 2) is hidden within the guideway 1 so that a bottom side 15 of the carrier 12 bears against the walls 5 and 6 thereof over its full extent, as indicated in FIGS. 2 and 4. To hold the conveyer 2 in the guideway 1 the inside of the walls 5 and 6 at one and the same level are provided with ribs or lugs 16 running over which are horizontally extending rollers 17 of the chain placed on the pins 14.

On the outside of the guideway 1 (FIG. 1) to fit the rectilinear portion A thereof there is attached a reed 18 (shown in the drawing schematically) having interspaces for warp threads 4 to pass through and two side walls 19 and 20. To match the rectilinear portion B on the outside of the guideway 1 there is secured a side wall 21. The walls 19, 20, 21 and the reed 18 are associated with the outer surface 22 of the weft thread carriers 12 as is shown in FIG. 2, the walls 19, 20 and 21 being identically made as strips placed vertically and attached at their lower edges to the outside of the wall 5 by screws 23. Since the carrier 12 is wider in cross-section than the guideway 1, for holding the side walls 19, 20 and 21 in the vertical position, placed between them and the wall 5 is a spacer strip or gasket 24. In the spacer strip or gasket are holes to receive the screws 23 driven into threaded holes in the wall 5.

The curvilinear portions C and D (FIG. 1) are also provided, respectively, with side walls 25 and 26 of the L-shaped cross-section, as is shown for walls 25 in FIG. 4, lower edges of these walls being attached to the wall 5 by screws 27 extending through a gasket or spacer strip 28 and the upper free edges respectively including flanges 25*a*, 26*a* inwardly directed toward the weft thread carriers 12.

Figure 5:
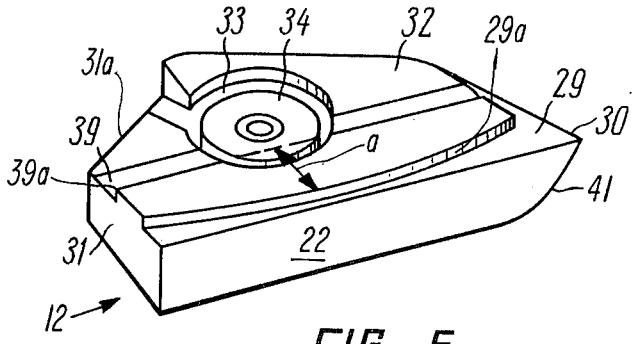
FIG. 5 is a perspective illustration of a weft thread carrier.

The outer surface 22 of the carrier 12 intersects an upper guide surface 29 limited inwardly of surface 22 by an arcuate shoulder 29*a* (FIG. 5). Thus, this guide surface 29 has a variable width i.e. in the middle part the surface 29 is narrower than near a carrier front tip 30 and rear end surface 31. The guide surface 29 and shoulder 29*a* (FIG. 4) slidably engage flanges 25*a*, 26*a*, of the side walls 25 and 26 respectively situated at the curvilinear portions C and D. The width of the surface 29 (FIG. 5) is at a minimum midway between the tip 30 and the rear surface 31.

The carrier 12 is formed, on its top side 32, with a well 33 accommodating a spool 34 with a reserve of the weft thread, and on its bottom side 15 (FIG. 3), with a well 35 engaged by the roller 13 retaining and propelling the carriers 12, the roller 13 cooperating with a roller 36 mounted in the carrier 12 (FIG. 3).

Above the curvilinear portion C (FIG. 1) and above the rectilinear portions A and B of the guideway 1, except for the part thereof disposed in the cloth forming zone, there is installed an additional guideway 37. The additional guideway 37 placed in plane of the flight of the carriers is in contact with the top surface 32 of the carriers 12 (as is shown in FIG. 4) and is secured with the aid of strips 38 (FIGS. 1 and 2) on the side walls 19, 20, 21, and 25. It will be noted that there is no guide 37 at the curvilinear portion D. Moreover, the guide 37 is shown partly broken away at the upper left portion of FIG. 1 so as to illustrate more clearly the conveyer structure 2 and one of the weft thread carriers 12 beneath the guide rail 37.

The carriers 12 (FIGS. 4 and 5) have at the top surfaces 32 thereof rectilinear flat guide surface portions 39 limited inwardly by a straight shoulder 39*a* and slidably engaging the additional guideway 37. A maximum width "*a*" (FIG. 5) of the upper carrier surface between the line along which shoulder 39*a* extends and the shoulder 29*a* is equal to the distance between the side walls 19, 20, 21, 25 and the additional guideway 37 at any point of travel of the carriers 12 along the guideway 1.

Above the curvilinear portion D (FIGS. 1 and 6) of the closed guideway 1, from the inside, i.e. over the portion 6*a* of wall 6, there are placed movable in plane of the flight of the weft thread carriers 12 and in step with the motion of the chain conveyer 2 retainers 40*a* and 40*b* which are in contact with a leading region 41 (FIG. 7) of the weft thread carriers 12. Portion 6*a* of wall 6 is made shorter than the remainder of wall 6 in order to accommodate part of the rotary disk 44, as is clear from FIGS. 7 and 8.

Figure 6:
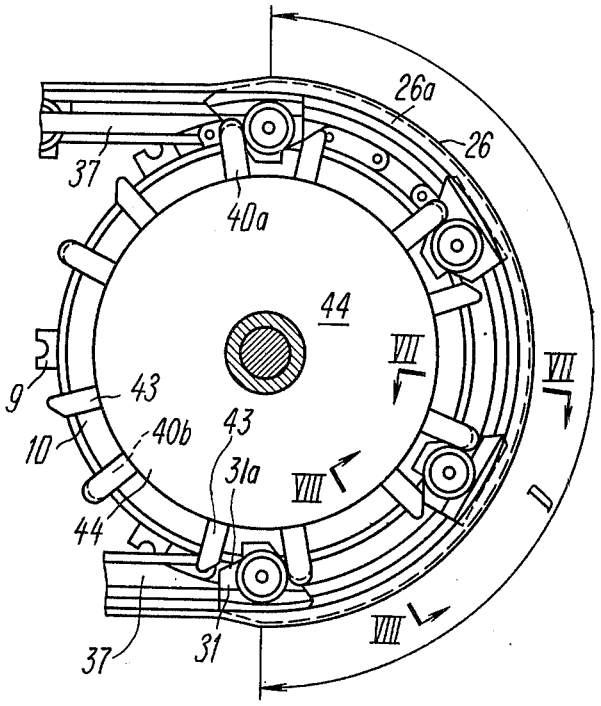
FIG. 6 shows a curvilinear portion D of a closed guideway of the apparatus according to the invention, top view with some details which are omitted from FIG. 1.
Figure 7:
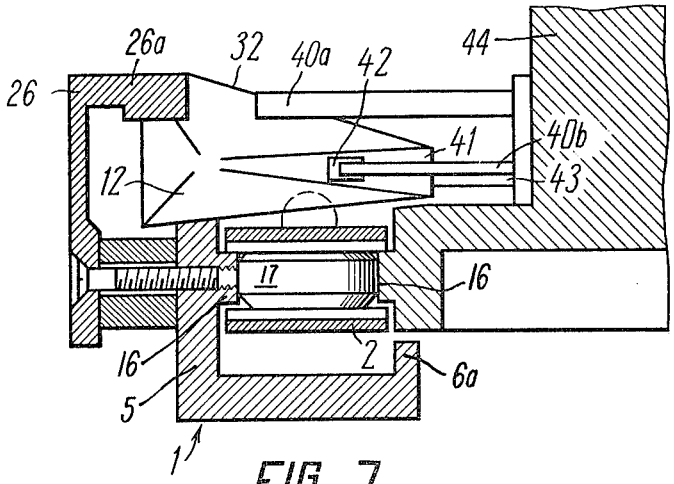
FIG. 7 is a section along line VII—VII in FIG. 6.

The movable retainers 40*a*, 40*b* are arranged vertically along the weft thread carriers 12 in two rows, the retainers 40*a* being situated above the shorter retainers 40*b*, respectively, as is shown in FIG. 7. In each row, the spacing between retainers 40*a*, 40*b* is equal to the spacing between the carriers 12 of the weft thread, as is shown in FIGS. 1 and 6.

In the leading region 41 of the carriers 12 there are recesses 42 (FIGS. 4 and 7) adapted to receive the retainers 40*b*, the recesses 42 being provided in the leading part of the carriers and intended, in the main, for the retainers 40*b* of the lower row. The retainers 40*a*, on the other hand, engage the flat surfaces 39 and shoulders 39*a* at a leading region of the carriers 12, as shown most clearly in FIG. 6 and as is also apparent from FIGS. 7 and 8.

Figure 8:
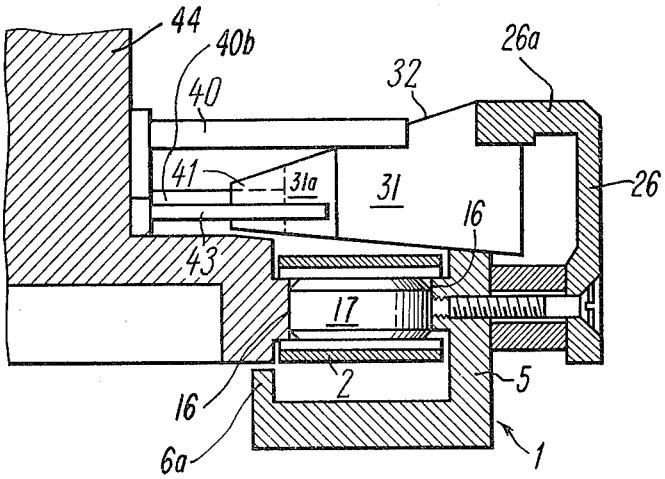
FIG. 8 is a section along line VIII—VIII in FIG. 6.

Near the retainers 40*a*, 40*b* there are placed, movable in the plane of flight of the weft, thread carriers 12 and in step with the motion of the chain conveyer 2 abutments 43 (FIG. 6) contacting inner inclined portions 31*a* of the rear surface 31 of the weft thread carriers 12, the abutments 43 being located at the level of the second or lower row of the retainers 40*b*, as is shown in FIGS. 7 and 8.

The retainers 40*a*, 40*b* and the abutments 43 extend radially and are secured on the turnable disk of 44 (FIG. 6) located at the inside of the closed guideway 1 and geared to the drive of the chain conveyer 2 or else to disk 10 of the device for winding the weft thread.

With the loom started, the device 11 (FIG. 1) for winding the weft thread onto the spools of the carriers 12 impart motion to the disk 10, and the teeth 9 of the latter engage the pins 14 of the links 7 and 8 and shift the chain conveyer 2 along the guideway 1 in the direction shown by arrow M (FIG. 1). Since the conveyer 2 runs within the guideway 1 (FIG. 3) the carriers 12 are displaced by the rollers 13 finding lodgement in the well 35 of the carrier. In this case, the carrier assumes a definite position since for its orientation used are: at the rectilinear portions A and B (FIG. 1) the side walls 19, 20, 21 and the additional guideway 37, and at the curvilinear portion C, the side wall 25 and the additional guideway 37.

Upon arrival at the curvilinear portion D the carrier 12 proves to be in permanent contact with the flange 26*a* and emerges from under the additional guideway 37.

Prior to this, the recess 42 of each carrier 12 receives a retainer 40*b* of the lower row (FIG. 7). This retainer performs the function of the additional guideway 37. The leading region 41 of each carrier 12 comes in contact with the retainers 40*a* of the upper row whereas the abutment 43 bears against the rear surface portion 31*a* of the carrier and the latter continues its uniform motion along the curvilinear portion D.

What is claimed is:

1. In a travelling wave loom having weft thread carriers and a cloth forming zone and apparatus for propelling the weft thread carriers, comprising: a closed stationary hollow guideway passing through said cloth forming zone and having two rectilinear and two curvilinear portions; a chain conveyer accommodated in said guideway; said weft thread carriers each having an outer surface, opposed end regions, and a top surface, and means for propelling the weft thread carriers mounted on said chain conveyer; side walls forming part of and being mounted on said guideway and contacting the outer surfaces of the weft thread carriers, said side walls including portions located at the curvilinear portions of said guideway which are of L-shaped configuration having upper flanges engaging said weft thread carriers; an additional guide situated above only one of the curvilinear portions and above the rectilinear portions of said guideway, except for a part thereof disposed in said cloth forming zone, said additional guide being situated in the plane of flight of the weft thread carriers and in contact with the top surfaces thereof; retainers arranged above the other curvilinear portion of said guideway on the inside thereof and movable in the plane of the flight of the weft thread carriers and in step with motion of said conveyer, said retainers contacting at least one of the end regions of the weft thread carriers; the upper surface of each of the weft thread carriers having an elongated flat surface and a shoulder extending therealong and defining therewith a space accommodating said additional guide, said one end region of each weft thread carrier being formed with a recess receiving one of said retainers.

2. An apparatus as claimed in claim 1 wherein the recesses are respectively situtated at leading end regions of the weft thread carriers.

3. An apparatus as claimed in claim 1, wherein the movable retainers are situated vertically the carriers in two rows one above the other and the spacing between the retainers in each row being equivalent to the spacing between the weft thread carriers.

4. An apparatus as claimed in claim 1, wherein the retainers engage a leading end region of said weft thread carriers while there are movable in the plane of flight of the weft thread carriers and in step with the motion of the chain conveyer abutments contacting a rear end region of the weft thread carriers.

5. An apparatus as claimed in claim 5, including a turnable disk, wherein the retainers and the abutments extend radially and are secured on said turnable disk, the latter being located at the inside of the closed guideway and geared to a drive of the chain conveyer.

6. In a travelling-wave loom having weft thread carriers and a cloth forming zone and apparatus for propelling the weft thread carriers, comprising: a closed stationary hollow guideway passing through said cloth forming zone and having two rectilinear and two curvilinear portions; a chain conveyer accommodated in said guideway; said weft thread carriers each having an outer surface, a pair of opposed end regions, and a top surface, and means for propelling the weft thread carriers mounted on said chain conveyor; side walls forming part of and being mounted on said guideway and contacting the outer surface of the weft thread carriers, said side walls including portions located at the curvilinear portions of said guideway and being of an L-shaped configuration including upper flanges engaging said weft thread carriers; an additional guide situated above only one of the curvilinear portions and also have the rectilinear portions of said guideway, except for a part thereof disposed in said cloth forming zone, said additional guide being situated in the plane of flight of the weft thread carriers and in contact with the top surface thereof; retainers arranged above the other curvilinear portion of said guideway on the inside thereof and movable in the plane of flight of the weft thread carriers and in step with motion of said conveyer, said retainers contacting one end region of the weft thread carriers; the upper surface of each weft thread carrier having an elongated flat portion and a shoulder extending therealong and defining therewith a space accommodating said additional guide, said movable retainers being situated vertically along the carriers in two rows, one above the other and the spacing between the retainers in each row being equivalent to the spacing between the weft thread carriers.

* * * * *